US009719252B1

(12) United States Patent
Olinek et al.

(10) Patent No.: US 9,719,252 B1
(45) Date of Patent: Aug. 1, 2017

(54) HOARDING SYSTEMS

(71) Applicants: Kyle Olinek, Langley (CA); Glenn Olinek, Langley (CA)

(72) Inventors: Kyle Olinek, Langley (CA); Glenn Olinek, Langley (CA)

( * ) Notice: Subject to any disclaimer, the term of this patent is extended or adjusted under 35 U.S.C. 154(b) by 0 days.

(21) Appl. No.: 15/005,330

(22) Filed: Jan. 25, 2016

(51) Int. Cl.
*E04B 2/74* (2006.01)
*E01F 15/08* (2006.01)

(52) U.S. Cl.
CPC ..... *E04B 2/7407* (2013.01); *E01F 15/086* (2013.01); *E01F 15/088* (2013.01); *E04B 2002/7461* (2013.01)

(58) Field of Classification Search
CPC ..... E04B 2/7407; E04B 2002/7461; E01F 15/086; E01F 15/088; E01F 13/022; E04G 17/14; E04G 21/26
See application file for complete search history.

(56) References Cited

U.S. PATENT DOCUMENTS 4,854,767 A * 8/1989 Sasaki ..... E01F 8/0064 116/63 P
5,611,641 A * 3/1997 Christensen ..... E01F 13/022 256/1
5,622,448 A * 4/1997 Baum ..... E02B 13/02 405/114
7,198,426 B2 * 4/2007 Kang ..... E01F 15/088 404/6
7,540,471 B2 6/2009 Hall
8,662,790 B2 * 3/2014 Phelps ..... E02B 3/108 403/298
2002/0121063 A1 * 9/2002 Mathias ..... E01F 13/022 52/578
2005/0034378 A1 * 2/2005 Underwood ..... A47B 46/005 52/36.1
2005/0135878 A1 * 6/2005 McNally ..... E01F 13/022 404/6
2007/0193218 A1 * 8/2007 Spransy ..... E04B 2/7453 52/782.1

(Continued)

FOREIGN PATENT DOCUMENTS

AU 2011101006 10/2011
CA 2292262 6/2001

(Continued)

*Primary Examiner* — Brian Glessner
*Assistant Examiner* — Omar Hijaz
(74) *Attorney, Agent, or Firm* — Integrity Patent Group, PLC; Edwin Wold

(57) ABSTRACT

A hoarding system including a hoarding assembly; the hoarding assembly includes one or more wall-boards, one or more corner-connectors, a length of vertical-u-channel, a length of lower-horizontal-u-channel, a length of upper-horizontal-u-channel, one or more angle-braces, and one or more back-brace-panels to be used in functional and structural combination. The one or more wall-boards are structured and arranged to align and connect horizontally to enclose an area to prevent unauthorized ingress into that area and may be connected by the corner-connectors to make a right-angle. The one or more wall-boards may further include a door to allow ingress and egress to the enclosed area by a user. A kit for a hoarding system is also included, as is a method of use for a hoarding system.

15 Claims, 5 Drawing Sheets

(56) References Cited

U.S. PATENT DOCUMENTS

| | | | | |
|---|---|---|---|---|
| 2008/0104922 | A1* | 5/2008 | Glick | E04B 2/7425 52/630 |
| 2014/0283459 | A1* | 9/2014 | Maxam | A63J 1/02 52/7 |

FOREIGN PATENT DOCUMENTS

| | | |
|---|---|---|
| CN | 103573018 | 2/2014 |
| GB | 2437603 | 10/2007 |
| WO | 2005108678 | 11/2005 |

* cited by examiner

HOARDING SYSTEMS

BACKGROUND OF THE INVENTION

The following includes information that may be useful in understanding the present invention(s). It is not an admission that any of the information provided herein is prior art, or material, to the presently described or claimed inventions, or that any publication or document that is specifically or implicitly referenced is prior art.

1. FIELD OF THE INVENTION

The present invention relates generally to the field of modular enclosures and more specifically relates to hoarding systems.

2. DESCRIPTION OF RELATED ART

Generally, construction hoarding and modular enclosures are systems that connect together to form a physical and visual barrier. Such systems are commonly used when it is desirable to prevent unwanted access to an area, to provide safety measures, or to conceal the area during construction or modifications to the area. Some systems require spikes or piles to be driven into the ground, which may limit the use of the system to an outdoor area that has a soft ground surface. Other systems may interconnect the panels with hinges, pins or other similar means. Additional systems require extensive supports that increase the overall setup and breakdown time.

One such limitation with commonly used hoarding systems is that they require the use of significant time and labor to install and many systems do not provide the flexibility to allow the system or installation be reused in a different location when the parameters of the installation are different. Also, installation or removal of the barrier or enclosure system may cause damage to the existing structure to which the system is affixed, which is undesirable.

Therefore it is desirable to provide a hoarding system that is temporary, removable, and reusable and allows the user to quickly and easily customize system dependent upon the requirements of the installation. Also desired is a quick and efficient setup and breakdown time of the hoarding.

Several attempts have been made to solve the above-mentioned problems such as those found in Foreign and U.S. Pat. And Pub. Nos. CN 103,573,018 to Chen et al., WO 2005/108678 to Whitehouse, CA 2,292,262 to Drouin, AU 2011/101006 to Etrik, GB 2,437,603 to Bowman, U.S. Pat. No. 7,540,471 to Hall, US 2005/0135878 to McNally et al., and US 2002/0121063 to Mathias et al. This art is representative of modular enclosures. However, none of the above inventions and patents, taken either singly or in combination, is seen to describe the invention as claimed.

Preferably, a hoarding system should provide an easily assembled, reusable, and customizable means for enclosing an area and, yet would operate reliably and be manufactured at a modest expense. Thus, a need exists for a reliable hoarding system to avoid the above-mentioned problems.

BRIEF SUMMARY OF THE INVENTION

In view of the foregoing disadvantages inherent in the known modular enclosure art, the present invention provides a novel hoarding system. The general purpose of the present invention, which will be described subsequently in greater detail is to provide a quickly erected system for enclosing an area, which is reusable and provides flexibility to be used in different locations, with different configurations.

A hoarding system is disclosed herein, in a preferred embodiment, the hoarding system comprising a hoarding assembly. The hoarding assembly may comprise one or more wall-boards, one or more corner-connectors, a length of vertical-u-channel, a length of lower-horizontal-u-channel, a length of upper-horizontal-u-channel, one or more angle-braces, and one or more back-brace-panels to be used in functional and structural combination. All such lengths may be cut or trimmed into individual sections and/or lengths as needed.

The one or more wall-boards may comprise of and be defined by a front-side, a back-side, a top-side, a bottom-edge, a tongue-side-edge, a groove-side-edge, and a plurality of hollow-columns. The tongue-side-edge and the groove-side-edge of the one or more wall-boards may be structured and arranged to align and/or connect horizontally to enclose an area to prevent unauthorized ingress into that area.

The one or more corner-connectors may comprise of and be defined by a top-end, a bottom-end, and two wall-board-channels; where the one or more corner-connectors may be structured and arranged to accept two of the wall-boards such that the wall-boards form a substantially 90-degree corner. The corner-connectors may be rotated vertically to form either a right, left, inside or outside corner. The one or more floor-connectors may be structured and arranged to support the one or more wall-boards in a substantially vertical position and the one or more wall-boards, the one or more corner-connectors, and the one or more floor-connectors may be structured and arranged to provide a modular enclosure able to be efficiently erected and disassembled with minimal impact to the surrounding structure or building. In the preferred embodiment, one of the one or more wall-boards may further comprise an integrated door to allow ingress and egress to the enclosed area by an authorized user. The door may further include a lock; preferably, the hinges of the door are located to the area to be confined to provide additional security to the area.

Preferably, the vertical-u-channel is removably affixable to a structure-wall-surface and the vertical-u-channel is structured and arranged to accept the one or more wall-boards to removably affix the one or more wall-boards to the structure-wall-surface to aid in vertical support of the one or more wall-boards.

In the preferred embodiment the upper-horizontal-u-channel is structured and arranged to be removably coupleable to the structure-wall-surface and to accept or one or more back-brace-panels. The lower-horizontal-u-channel may be removably affixable to the one or more wall-boards. The one or more angle-braces may be structured and arranged to removably affix the one or more back-brace-panels to the length of lower-horizontal-u-channel to provide vertical support to the one or more wall-boards.

The preferred embodiment of the hoarding system includes construction and assembly where the brace-floor-channel is removably affixable to the floor-surface by double-sided tape or similar adhesive means, and the vertical-u-channel is removably affixable to the structure-wall-surface by double-sided tape or similar adhesive, and the upper-horizontal-u-channel is also removably affixable to the structure-wall-surface by similar means. Additionally, lower-horizontal-u-channel is removably affixable to the one or more wall-boards by fasteners (e.g., screws, bolts, nails, etc.) and the one or more angle-braces are removably affixable to the back-brace-panels, also by fasteners or similar devices.

A kit is also disclosed herein, with the kit including, but not limited to, one or more wall-boards, one or more corner-connectors, one or more floor-connectors, a length of vertical-u-channel, a length of lower-horizontal-u-channel, a length of upper-horizontal-u-channel, one or more one or more angle-braces, double-sided tape, fasteners, and a set of user instructions.

A method of using a hoarding system is additionally disclosed herein. The method may comprise the steps of providing a hoarding assembly and erecting the hoarding assembly to enclose an area to prevent unauthorized ingress into that area. The method may further comprise the steps of disassembling the hoarding assembly, and removing the double-sided tape.

The present invention holds significant improvements and serves as a hoarding system. For purposes of summarizing the invention, certain aspects, advantages, and novel features of the invention have been described herein. It is to be understood that not necessarily all such advantages may be achieved in accordance with any one particular embodiment of the invention. Thus, the invention may be embodied or carried out in a manner that achieves or optimizes one advantage or group of advantages as taught herein without necessarily achieving other advantages as may be taught or suggested herein. The features of the invention which are believed to be novel are particularly pointed out and distinctly claimed in the concluding portion of the specification. These and other features, aspects, and advantages of the present invention will become better understood with reference to the following drawings and detailed description.

BRIEF DESCRIPTION OF THE DRAWINGS

The figures which accompany the written portion of this specification illustrate embodiments and method(s) of use for the present invention, hoarding systems, constructed and operative according to the teachings of the present invention.

The various embodiments of the present invention will hereinafter be described in conjunction with the appended drawings, wherein like designations denote like elements.

DETAILED DESCRIPTION

Figure 1:
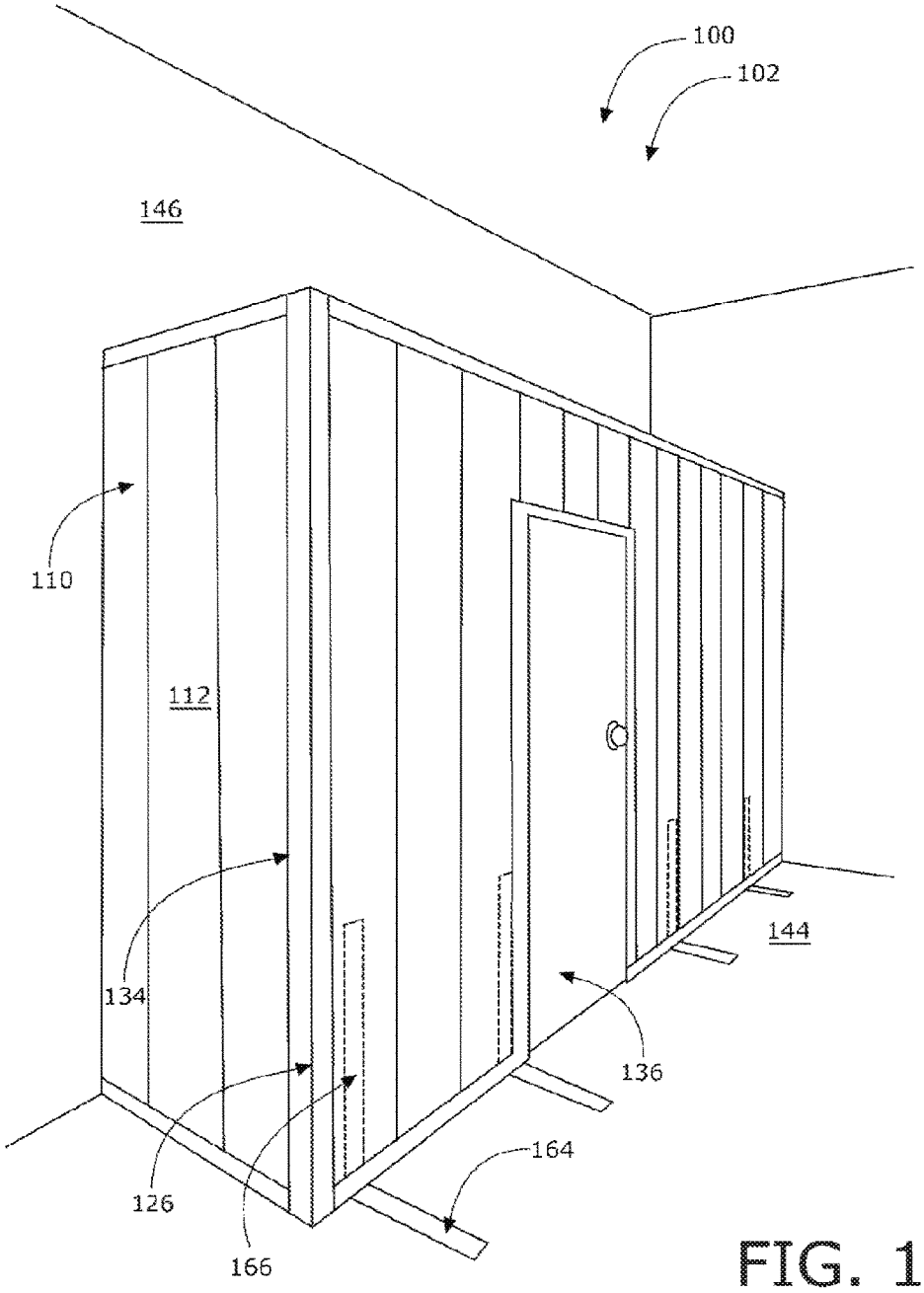
FIG. 1 shows a perspective view illustrating an assembled hoarding system to enclose an area according to an embodiment of the present invention.

As discussed above, embodiments of the present invention relate to a modular enclosures and more particularly to a hoarding system as used to improve the ease of assembly, reusability, and customization capabilities of a modular enclosure.

Generally speaking, a hoarding system can be easily constructed by an individual or individuals in a short amount of time with the flexibility to be customizable to fit a wide variety of applications, while maintaining the ability of the components of the hoarding system to be reusable at a different location as needed and desired.

Referring to the drawings by numerals of reference there is shown in FIGS. 1-4, hoarding system 100 comprising hoarding assembly 102. Hoarding assembly 102 comprises and is defined by one or more wall-boards 110, one or more corner-connectors 126, and one or more floor-connectors 160 used in functional and structural combination to provide a modular enclosure able to be efficiently erected and disassembled. Floor-connector 160 is structured and arranged to support one or more wall-boards 110 in a substantially vertical position.

Figure 3:
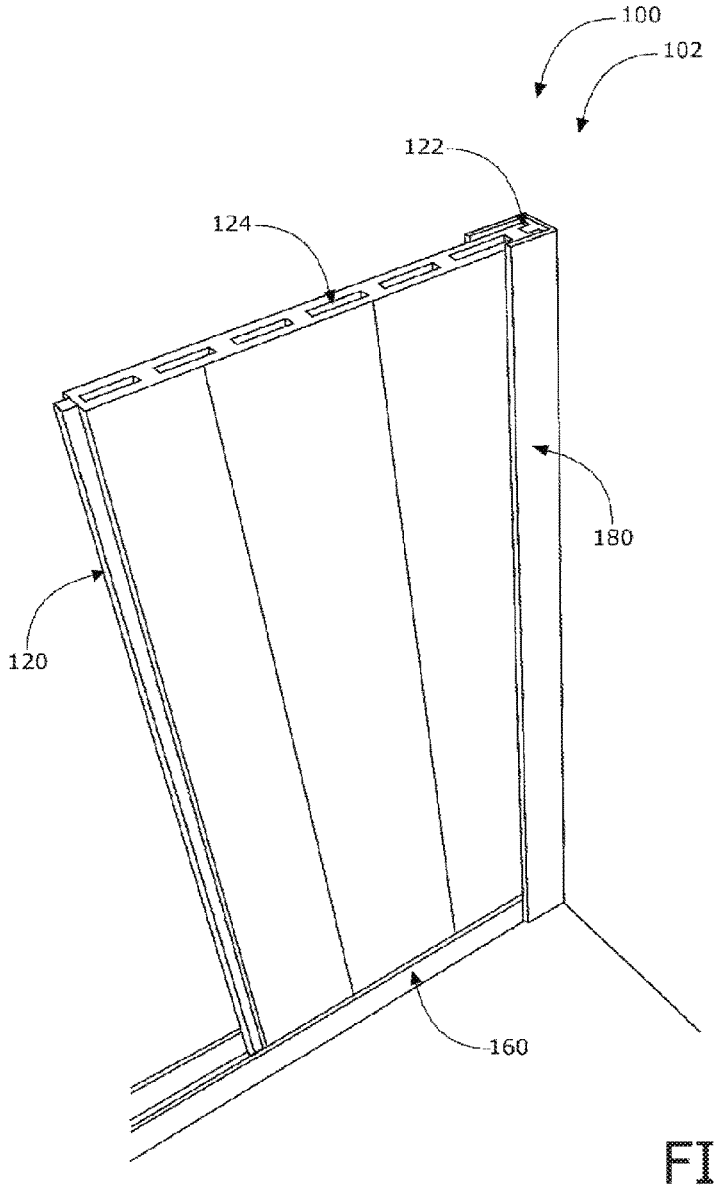
FIG. 3 is a perspective view illustrating a wall-board and vertical-u-channel of a hoarding assembly according to an embodiment of the present invention of FIGS. 1-2.

Each wall-board 110 comprises and is defined by front-side 112, back-side 114, top-side 116, bottom-edge 118, tongue-side-edge 120, groove-side-edge 122, and plurality of hollow-columns 124, as shown in FIG. 3. Tongue-side-edge 120 and groove-side-edge 122 of each wall-board 110 is structured and arranged to align and connect horizontally to enclose area to prevent unauthorized ingress to area 142. One of each wall-board 110 may further comprise door 136 to allow authorized access into and out of area 142. Wall-board 110 may be constructed from fire-resistant material to provide safety.

Referring now more specifically to FIG. 1, each corner-connector 126 of hoarding assembly comprises and is defined by top-end 128, bottom-end 130, and two wall-board-channels 134, where each corner-connector is structured and arranged to accept two of wall-boards in each wall-board-channel 134 to form a substantially 90-degree corner.

Also shown in FIG. 1, embodiments of hoarding system 100 may include floor-connector 160 which further comprises t-bar connector 162. T-bar connector 162 comprises base-member 164 and vertical-member 166, where base-member 164 lies in a plane which is substantially parallel to floor-surface 144 and vertical member 166 is removably insertable into one of plurality of hollow-columns 124 of one or more wall-boards 110 to provide vertically stability to one or more wall-boards 110.

Figure 2:
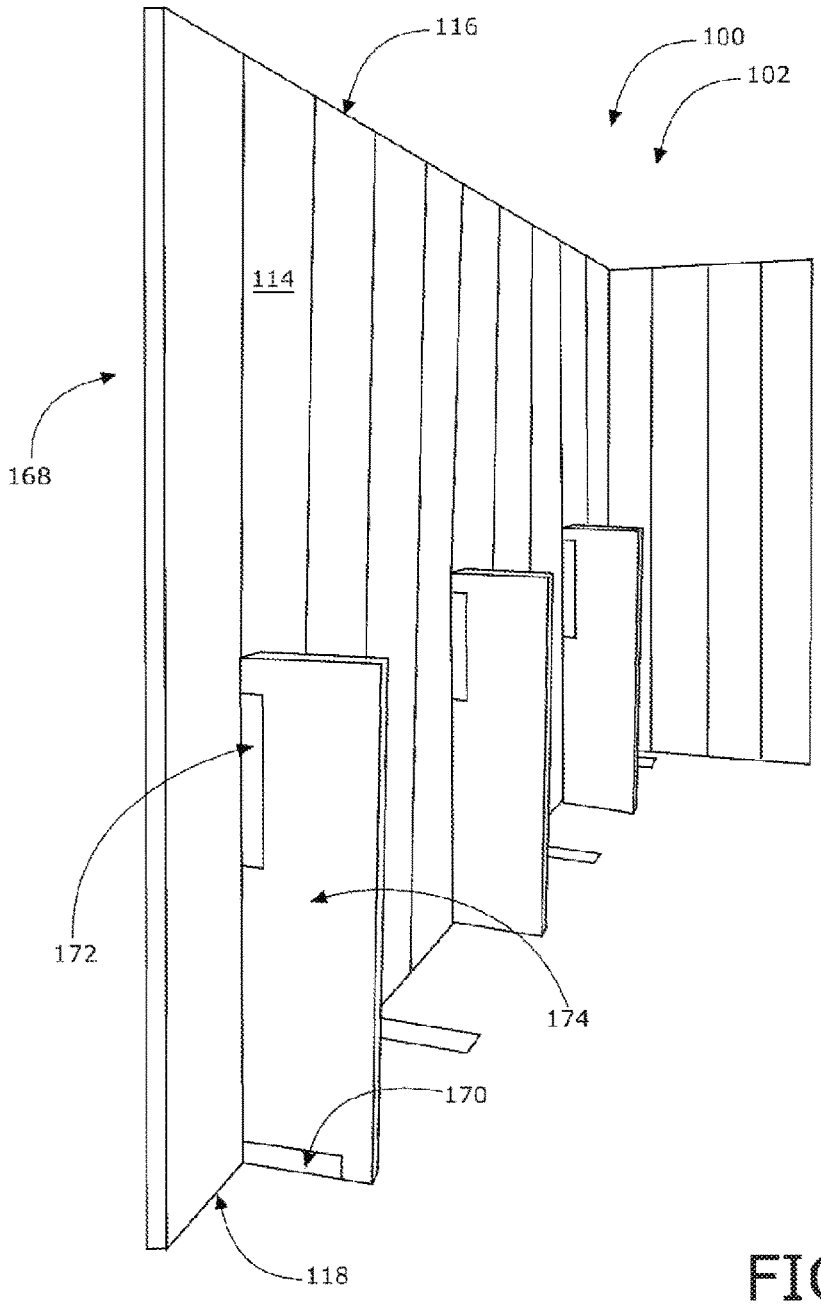
FIG. 2 is a perspective view illustrating the hoarding system, from inside the area to be enclosed, further comprising a back-brace and the components of the back-brace according to an embodiment of the present invention of FIG. 1.

Referring now to FIG. 2, a hoarding assembly 102 may further comprise back-brace 168, with back-brace 168 comprising one or more brace-floor-channels 170, one or more brace-wall-channels 172, and one or more brace-panels 174. Each brace-panel 174 comprise four edges and two faces and may be shorter in height than wall-board 110. Brace-floor-channel 170 is removably affixable to floor-surface 144 by double-sided tape or other adhesive-type securing means.

Referring still to FIG. 2 brace-floor-channel 170 is structured and arranged to be removably affixable to floor-surface 144 and one of edges of one or more brace-panels 174. One or more brace-wall-channels 172 is structured and arranged to be removably affixable to one of edges of one or more brace-panels 174 of back-side of wall-board 110. Back-brace 168 is structured and arranged to provide vertical support to one or more wall-boards 110.

Figure 4:
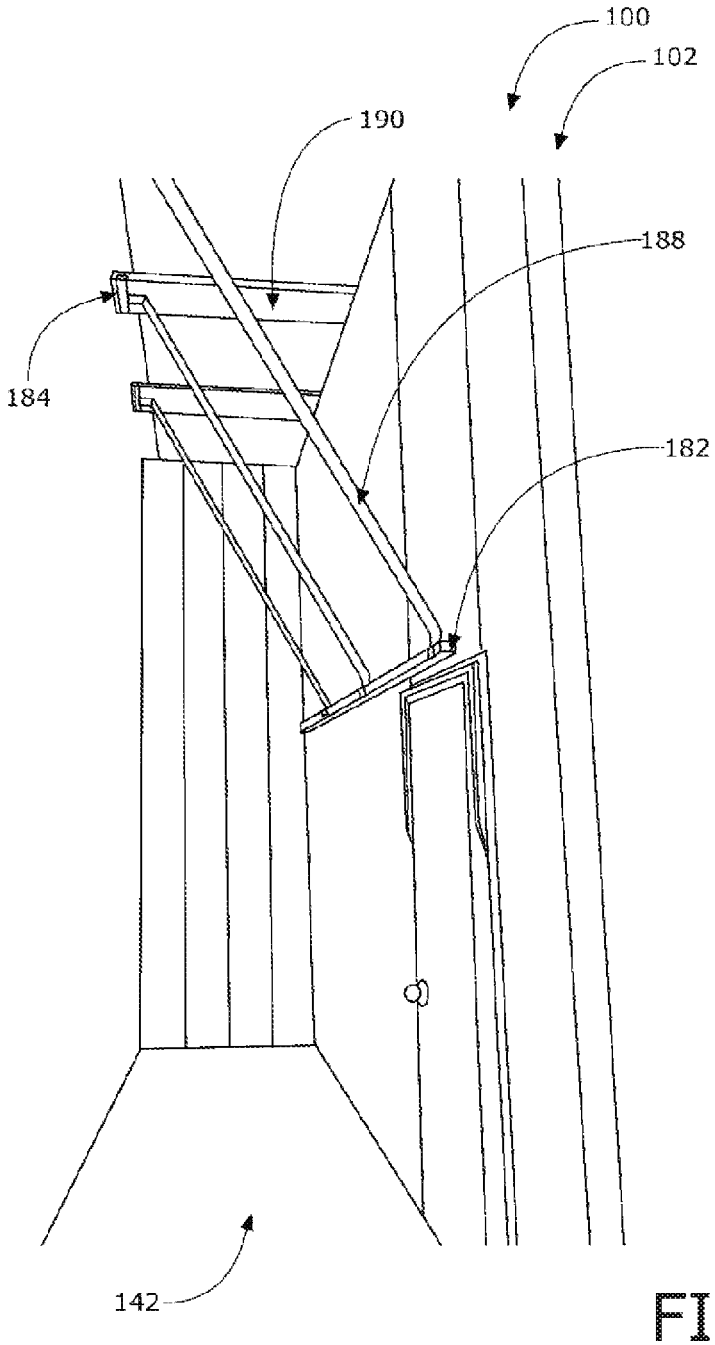
FIG. 4 is a perspective view illustrating a hoarding system comprising a plurality of angle-braces and associated components according to an embodiment of the present invention of FIGS. 1-3.

As shown in FIG. 4, hoarding system 100 may comprise lower-horizontal-u-channel 182, upper-horizontal-u-channel 184, angle-brace 188, and back-brace-panels 190. Vertical-u-channel may also be included in hoarding system 100. Vertical-u-channel 180, as can be seen in FIG. 3, is removably affixable structure-wall-surface 146 by double-sided tape, fasteners, or other suitable means (e.g., adhesive, VELCO®, etc.) and is structured and arranged to accept one or more wall-boards 110.

Additionally, vertical-u-channel 180 is structured and arranged to affix one or more wall-boards 110 to structure-wall-surface 146 to aid in vertical support of one or more wall-boards 110. Upper-horizontal-u-channel 184 is structured and arranged to be removably affixable to structure-wall-surface 146 by double-sided tape, fasteners, or other suitable means and is further structured and arranged to accept or one or more back-brace-panels 190.

Lower-horizontal-u-channel 182 is removably affixable to one or more wall-boards 110 by double-sided tape, fasteners, or other suitable means. One or more angle-braces 188 are structured and arranged to removably affix back-brace-panels 190 to lower-horizontal-u-channel 182 to provide vertical support to wall-board 110. Angle-braces 188 are removably affixable to back-brace-panel 190 by double-sided tape, fasteners, or other suitable means.

Hoarding system 100 may be sold as a kit comprising the following parts: at least one wall-board 110 at least one corner-connector 126; at least one vertical-u-channel 180; at least one lower-horizontal-u-channel 182; at least one upper-horizontal-u-channel 184; at least one angle-brace 188; double-sided tape; fasteners; and at least one set of user instructions. The kit has instructions such that functional relationships are detailed in relation to the structure of the invention (such that the invention can be used, maintained, or the like in a preferred manner). Hoarding system 100 may be manufactured and provided for sale in a wide variety of sizes and shapes for a wide assortment of applications. Upon reading this specification, it should be appreciated that, under appropriate circumstances, considering such issues as design preference, user preferences, marketing preferences, cost, structural requirements, available materials, technological advances, etc., other kit contents or arrangements such as, for example, including more or less components, customized parts, different color combinations, parts may be sold separately, etc., may be sufficient.

Figure 5:
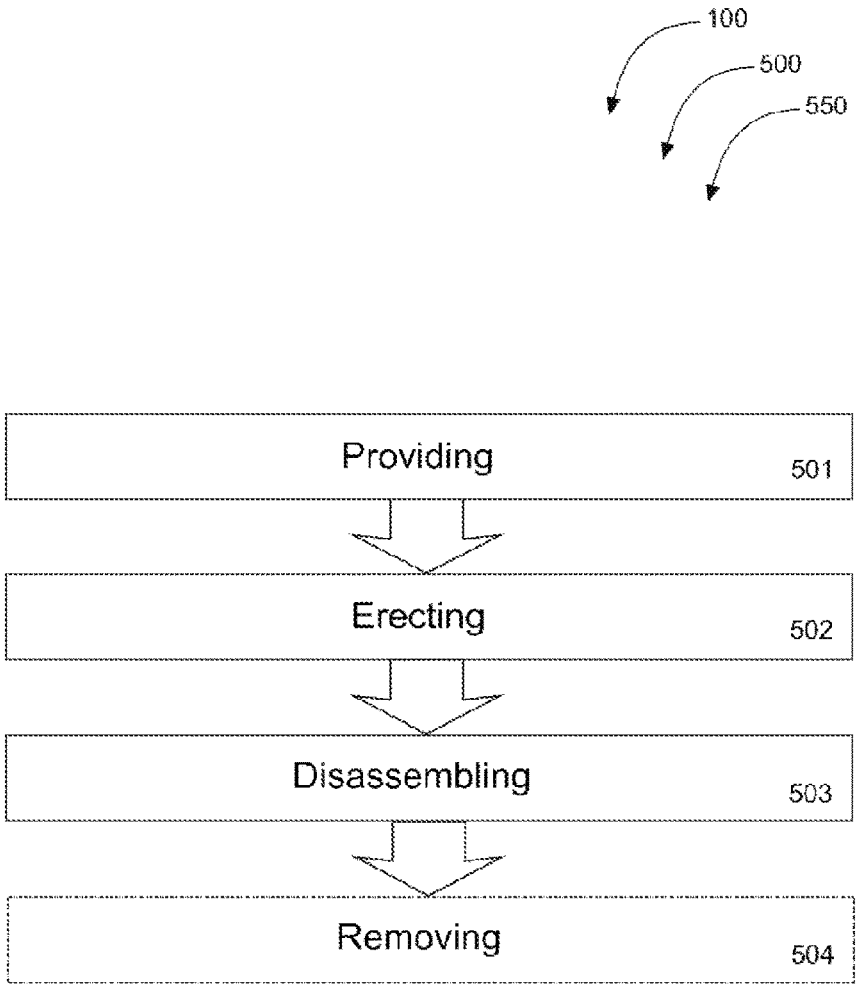
FIG. 5 is a flowchart illustrating a method of use for hoarding system according to an embodiment of the present invention of FIGS. 1-4.

Referring now to FIG. 5 showing flowchart 550 illustrating method of use 500 for hoarding system 100 according to an embodiment of the present invention of FIGS. 1-4. As shown, method of use 500 may comprise the steps of: step one 501, providing a hoarding assembly 102 (comprising one or more wall-boards 110, one or more corner-connectors 126, one or more floor-connectors 160, a length of vertical-u-channel 180, a length of lower-horizontal-u-channel 182, a length of upper-horizontal-u-channel 184, one or more angle-braces 188, one or more back-brace-panels 190, double-sided tape, and fasteners); step two 502, erecting hoarding assembly 102 to enclose area 142 to prevent unauthorized ingress into area 142; step three 503, disassembling hoarding assembly 102; and step four 504, removing double-sided tape.

It should be noted that step four 504 is an optional step and may not be implemented in all cases. Optional steps of method of use 500 are illustrated using dotted lines in FIG. 5 so as to distinguish them from the other steps of method of use 500.

It should be noted that the steps described in the method of use can be carried out in many different orders according to user preference. The use of "step of" should not be interpreted as "step for", in the claims herein and is not intended to invoke the provisions of 35 U.S.C. §112, ¶6. Upon reading this specification, it should be appreciated that, under appropriate circumstances, considering such issues as design preference, user preferences, marketing preferences, cost, structural requirements, available materials, technological advances, etc., other methods of use arrangements such as, for example, different orders within above-mentioned list, elimination or addition of certain steps, including or excluding certain maintenance steps, etc., may be sufficient.

The embodiments of the invention described herein are exemplary and numerous modifications, variations and rearrangements can be readily envisioned to achieve substantially equivalent results, all of which are intended to be embraced within the spirit and scope of the invention. Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application.

What is claimed is new and desired to be protected by Letters Patent is set forth in the appended claims:

1. A hoarding system comprising:

a) a hoarding assembly comprising;

i) one or more wall-boards each comprising;

(a) a front-side;

(b) a back-side;

(c) a top-side;

(d) a bottom-edge;

(e) a tongue-side-edge;

(f) a groove-side-edge; and (g) a plurality of hollow-columns;

ii) one or more corner-connectors comprising;

(a) a top-end;

(b) a bottom-end; and (c) two wall-board-channels; and (d) one or more floor-connectors;

iii) a length of vertical-u-channel;

iv) a length of lower-horizontal-u-channel;

v) a length of upper-horizontal-u-channel;

vi) one or more angle-braces;

vii) and one or more back-brace-panels;

c) wherein said hoarding assembly comprises said one or more wall-boards, said one or more corner-connectors, and said one or more floor-connectors used in functional and structural combination;

d) wherein said one or more wall-boards each is defined by said front-side, said back-side, said top-side, said bottom-edge, said tongue-side-edge, said groove-side-edge, and said plurality of hollow-columns;

e) wherein said tongue-side-edge and said groove-side-edge of said one or more wall-boards are structured and arranged to align and connect horizontally to enclose an area to prevent unauthorized ingress to said area;

f) wherein said one or more corner-connectors comprises said top-end, said bottom-end, and said two wall-board-channels;

g) wherein said one or more corner-connectors is structured and arranged to accept two of said wall-boards to form a substantially 90-degree corner;

h) wherein said one or more floor-connectors are structured and arranged to support said one or more wall-boards in a substantially vertical position; and i) wherein said one or more wall-boards, said one or more corner-connectors, and said one or more floor-connectors are structured and arranged to provide a modular enclosure;

j) wherein said one or more wall-boards of said hoarding assembly further comprises a door;

k) wherein said vertical-u-channel is removably affixable to a structure-wall-surface;

l) wherein said vertical-u-channel is structured and arranged to accept said one or more wall-boards;

m) wherein said vertical-u-channel is structured and arranged to affix said one or more wall-boards to said structure-wall-surface to aid in vertical support of said one or more wall-boards;

n) wherein said upper-horizontal-u-channel is structured and arranged to be removably affixable to said structure-wall-surface;

o) wherein said upper-horizontal-u-channel is structured and arranged to accept or one or more back-brace-panels;

p) wherein said lower-horizontal-u-channel is removably affixable to said one or more wallboards; and q) wherein said one or more angle-braces are structured and arranged to removably affix to said one or more back-brace-panels to said length of lower-horizontal-u-channel to provide vertical support to said one or more wall-boards.

2. The hoarding system of claim 1 wherein said one or more floor-connectors comprises:

a) a t-bar connector comprising;

i) a base-member; and ii) a vertical-member;

b) wherein said base-member lies in a plane which is substantially parallel to a floor surface; and c) wherein said vertical member is removably insertable into one of said plurality of d) hollow-columns of said one or more wall-boards to provide vertically stability to said one or more wall-boards.

3. The hoarding system of claim 2 wherein said hoarding assembly further comprises:

a) a back-brace comprising;

i) one or more brace-floor-channels;

ii) one or more brace-wall-channels; and iii) one or more brace-panels; comprising (a) four edges; and (b) two faces;

b) wherein said one or more brace-floor-channels is structured and arranged to be removably affixable to the floor surface and one of said edges of said one or more brace-panels;

c) wherein said one or more brace-wall-channels is structured and arranged to be removably affixable to one of said edges of said one or more brace-panels of said back-side of said one or more wall-boards; and d) wherein said back-brace is structured and arranged to provide vertical support to said one or more wall-boards.

4. The hoarding system of claim 3 wherein said one or more brace-wall-panels are of a shorter height than that of said one or more wall-boards.

5. The hoarding system of claim 3 wherein said one or more brace-floor-channels are removably affixable to said floor-surface via double-sided tape.

6. The hoarding system of claim 1 wherein said vertical-u-channel is removably affixable to said structure-wall-surface via double-sided tape.

7. The hoarding system of claim 1 wherein said upper-horizontal-u-channel is removably affixable to said structure-wall-surface via double-sided tape.

8. The hoarding system of claim 1 wherein said lower-horizontal-u-channel is removably affixable to said one or more wall-boards via double-sided tape.

9. The hoarding system of claim 1 wherein said one or more angle-braces is removably affixable to said back-brace-panels via double-sided tape.

10. The hoarding system of claim 1 wherein said vertical-u-channel is removably affixable to said structure-wall-surface via fasteners.

11. The hoarding system of claim 1 wherein said upper-horizontal-u-channel is removably affixable to said structure-wall-surface via fasteners.

12. The hoarding system of claim 1 wherein said lower-horizontal-u-channel is removably affixable to said one or more wall-boards via fasteners.

13. The hoarding system of claim 1 wherein said one or more angle-braces is removably affixable to said back-brace-panels via fasteners.

14. The hoarding system of claim 1 wherein said one or more wall-boards is constructed from fire-resistant material.

15. A hoarding system comprising:

a) a hoarding assembly comprising;

i) one or more wall-boards each comprising;

(a) a front-side;

(b) a back-side;

(c) a top-side;

(d) a bottom-edge;

(e) a tongue-side-edge;

(f) a groove-side-edge; and (g) a plurality of hollow-columns;

ii) one or more corner-connectors comprising;

(a) a top-end;

(b) a bottom-end; and (c) two wall-board-channels; and iii) a length of vertical-u-channel;

iv) a length of lower-horizontal-u-channel;

v) a length of upper-horizontal-u-channel;

vi) one or more angle-braces; and vii) one or more back-brace-panels;

b) wherein said hoarding system comprises said hoarding assembly;

c) wherein said hoarding assembly comprises said one or more wall-boards, said one or more corner-connectors, and said one or more floor-connectors used in functional and structural combination;

d) wherein said one or more wall-boards each is defined by said front-side, said back-side, said top-side, said bottom-edge, said tongue-side-edge, said groove-side-edge, and said plurality of hollow-columns;

e) wherein said tongue-side-edge and said groove-side-edge of said one or more wall-boards are structured and arranged to align and connect horizontally to enclose an area to prevent unauthorized ingress into said area;

f) wherein said one or more corner-connectors comprises said top-end, said bottom-end, and said two wall-board-channels;

g) wherein said one or more corner-connectors is structured and arranged to accept two said wall-boards to form a substantially 90-degree corner;

h) wherein said one or more floor-connectors is structured and arranged to support said one or more wall-boards in a substantially vertical position;

i) wherein said one or more wall-boards, said one or more corner-connectors, and said one or more floor-connectors are structured and arranged to provide a modular enclosure;

j) wherein one of said one or more wall-boards of said hoarding assembly further comprises a door;

k) wherein said vertical-u-channel is removably affixable to a structure-wall-surface;

l) wherein said vertical-u-channel is structured and arranged to accept said one or more wall-boards;

m) wherein said vertical-u-channel is structured and arranged to removably affix said one or more wall-boards to said structure-wall-surface to aid in vertical support of said one or more wall-boards;

n) wherein said upper-horizontal-u-channel is structured and arranged to be removably coupleable to said structure-wall-surface;

o) wherein said upper-horizontal-u-channel is structured and arranged to accept or one or more back-brace-panels;

p) wherein said lower-horizontal-u-channel is removably affixable to said one or more wall boards;

q) wherein said one or more angle-braces are structured and arranged to removably affix to said one or more back-brace-panels to said length of lower-horizontal-u-channel to provide vertical support to said one or more wall-boards;

r) wherein said brace-floor-channel is removably affixable to said floor-surface via double sided tape;

s) wherein said vertical-u-channel is removably affixable to said structure-wall-surface via said double-sided tape;

t) wherein said upper-horizontal-u-channel is removably affixable to said structure-wall surface via said double-sided tape;

u) wherein said lower-horizontal-u-channel is removably affixable to said one or more wall boards via fasteners;

v) wherein said one or more angle-braces is removably affixable to said back-brace-panels via said fasteners; and w) wherein said one or more wall-boards is constructed from fire-resistant material.

* * * * *